US005474297A

United States Patent [19]

Levin

[11] Patent Number: 5,474,297

[45] Date of Patent: Dec. 12, 1995

[54] GOLF CLUBS FOR HITTING LOW TRAJECTORY SHOTS

[76] Inventor: John M. Levin, 412 Fairview Rd., Narberth, Pa. 19072

[21] Appl. No.: 353,738

[22] Filed: Dec. 12, 1994

Related U.S. Application Data

[63] Continuation of Ser. No. 49,745, Apr. 19, 1993, abandoned.

[51] Int. Cl.[6] ..... A63B 53/04

[52] U.S. Cl. ..... 273/169; 273/167 A; 273/167 F

[58] Field of Search ..... 273/167 R, 167 A, 273/167 F, 169, 173, 174, 78, 172, 167 E, 193 R, 194 R, 80 R, 81 R, 167 J; D21/214, 219, 220

[56] References Cited

U.S. PATENT DOCUMENTS

| | | | |
|---|---|---|---|
| 645,944 | 3/1900 | Dalgleish | 273/169 |
| 722,011 | 3/1903 | Govan | 273/169 |
| 1,497,578 | 6/1924 | Mothersele | 273/167 F |
| 1,617,090 | 2/1927 | Worthington | 273/167 A |
| 1,993,928 | 3/1935 | Glover | 273/167 F |
| 2,007,377 | 7/1935 | Link | 273/167 F |
| 2,447,967 | 8/1948 | Stone | 273/78 |
| 3,240,497 | 3/1966 | Taylor | 273/173 X |
| 3,250,536 | 5/1966 | Moser | 273/167 F |
| 3,761,095 | 9/1973 | Thompson . | |
| 3,941,390 | 3/1976 | Hussey | 273/167 F |
| 3,984,103 | 10/1976 | Nix | 273/77 A |
| 4,065,133 | 12/1977 | Gordos | 273/167 E |
| 4,147,349 | 4/1979 | Jeghers | 273/77 A |
| 4,508,349 | 4/1985 | Gebauer . | |
| 4,653,756 | 3/1987 | Sato | 273/167 E |
| 4,687,205 | 8/1987 | Tominaga . | |
| 4,762,322 | 8/1988 | Molitor . | |
| 4,795,158 | 1/1989 | Kuykendall | 273/167 B X |
| 4,834,387 | 5/1989 | Waites et al. | 273/172 X |
| 4,938,470 | 7/1990 | Antonious . | |
| 5,094,457 | 3/1992 | Kinoshita . | |

FOREIGN PATENT DOCUMENTS

| | | | |
|---|---|---|---|
| 22113 | of 1910 | United Kingdom | 273/167 A |

*Primary Examiner*—Sebastiano Passaniti
*Attorney, Agent, or Firm*—Caesar, Rivise, Bernstein, Cohen & Pokotilow, Ltd.

[57] ABSTRACT

Golf clubs for use in providing low trajectory shots out of difficult terrain include a club shaft and a club head attached at a lower end of the club shaft. The height of the club is less than 40 inches. The club head has a forward club face for engaging a golf ball, and this club face is sloped at an angle of between 2 degrees and 7 degrees. Moreover, more than ½ of the club head weight is located in the lower ½ of the height of the club head.

17 Claims, 3 Drawing Sheets

GOLF CLUBS FOR HITTING LOW TRAJECTORY SHOTS

This application is a continuation of application Ser. No. 08/049,745, filed Apr. 19, 1993, now abandoned.

BACKGROUND OF THE INVENTION

This invention relates generally to golf clubs, and more specifically to golf clubs which are designed to provide controlled (i.e., accurate), long distance, low trajectory shots, and which are ideally suited for use in high grass and in other terrain from which it is difficult to hit the ball (e.g., from under trees or from under other heavy shrubbery).

The prior art is replete with golf clubs of varying designs, to achieve a number of different objectives. However, to applicant's knowledge, prior to the instant invention there has not been any golf club which adequately provides for controlled, long-distance, low trajectory shots in high grass, and in other terrain from which it is difficult to hit the ball (e.g., from under trees or from under other heavy shrubbery).

Prior to this invention the above-types of shots were made by the golfer taking a flat-faced club, i.e., a 1 or 2 iron, choking up on it, and hitting the ball off the back foot with a short, choppy swing. Shooting a golf ball off the back foot is a difficult shot, even for professionals, and the use of short choppy strokes results in a sacrifice of distance.

While bits and pieces of applicant's invention may be found in a number of different prior art patents, the unique, overall combination of applicant's invention simply is not disclosed nor rendered obvious by any of these prior art teachings.

The U.S. Pat. Nos. (3,761,095) to Thompson; Tominaga et al. (4,687,205); Molitor et al. (4,762,322); Kinoshita (5,094,457) and Waites et al. (4,834,387), all disclose golf clubs wherein the center of gravity of the head is adjusted to what appears to be the lower region of the club. In many of these later disclosures the weight distribution is achieved or adjusted through the addition of weights.

The Waites et al. '387 patent specifically describes a putter, and specifies that the face angle for the putter preferably be between 7–11 degrees, but could be lower. Although the Waites et al. patent states that the principles described in it could be applied to designing other clubs, there is no specific teaching or suggestion as to the face angle that would be employed in such other clubs. Moreover, the combination of the various features required in the design of the low trajectory golf clubs of the present invention simply is not disclosed or suggested in the Waites et al. '387 patent.

The U.S. Pat. No. (4,508,349) to Gebauer et al. discloses a golf club in the form of a driver or wood, wherein the loft angle of the face is described as being between 8 and 18 degrees, but does suggest that the invention is useful for other loft angles. Again, there simply is no disclosure or suggestion of the specific combination of elements employed in the low trajectory golf clubs of the present invention.

The U.S. Pat. No. (4,938,470) to Antonious discloses a number of different arrangements for varying the weight distribution in the head of a golf club. Again, the overall combination of elements of applicant's low trajectory golf clubs simply is not disclosed or suggested in the Antonious '470 patent.

In summary, prior to this invention there has not been a golf club which can be employed satisfactorily in a conventional manner employing a conventional grip and swing, to hit controlled, long distance, low trajectory shots, out of high grass, from under trees and from under other heavy shrubbery, and in other terrain from which it is difficult to hit a golf ball.

OBJECTS OF THE INVENTION

It is a general object of this invention to provide a golf club which is ideally suited for use in providing low trajectory shots out of difficult terrain.

It is a further object of this invention to provide a golf club for use in providing low trajectory shots out of difficult terrain, by employing a normal grip and a smooth (not choppy) stroke.

It is a further object of this invention to provide a golf club for providing low trajectory shots out of difficult terrain, wherein the golf ball can be played from approximately the middle to the front of the golfer's stance.

It is a further object of this invention to provide a golf club for use in providing low trajectory shots out of difficult terrain, either in the form of a wood or iron.

It is a further object of this invention to provide a golf club for use in providing low trajectory shots out of difficult terrain, wherein minimum frictional resistance is encountered between the club and the terrain through which the golf club is moved during a golfer's shot.

It is another object of this invention to provide a golf club which is ideally suited for use in providing long distance, low trajectory shots out of difficult terrain.

It is a more specific object of this invention to provide a golf club which is ideally suited for use in providing long distance, controlled, low trajectory shots out of difficult terrain.

It is a further object of this invention to provide a golf club which is ideally suited for use in providing controlled, low trajectory shots out of difficult terrain, in the range of 10–165 yards.

It is still a further object of this invention to provide a golf club which is ideally suited for use in providing low trajectory shots out of difficult terrain, and which are designed for hitting a golf ball a maximum distance of no more than approximately 175 yards, and most preferably no more than 150 yards.

SUMMARY OF THE INVENTION

The above and other objects of this invention are provided by a golf club comprising a club shaft and a club head attached at the lower end of the club shaft, and wherein the height of the club from the lowermost surface of the club head to the uppermost surface of the club shaft is less than 40 inches. Moreover, the club head has a forward club face for engaging a golf ball, and that face is sloped at an angle of between 2 degrees and 7 degrees, with more than ½ of the club head weight being located in the lower ½ of the club head.

In a preferred embodiment of the invention the club face is sloped at an angle $\alpha$ of between 5 degrees and 7 degrees, and most preferably is approximately 7 degrees.

In a preferred embodiment of this invention approximately ¾ or more of the club head weight is located in the lower ½ of the golf head, and more preferably in the lower ¼ of the club head.

In a preferred embodiment of this invention the overall height of the club is less than 40 inches and greater than 35 inches, and more preferably is approximately 36 inches.

In a preferred embodiment of this invention the lower surface of the club head is provided with a plurality of spaced-apart, curved projections to provide low frictional resistance with the terrain through which the club head is swung.

In a preferred embodiment of this invention a section of the golf head is provided by a weighted plate member having a plurality of spaced-apart, curved projections on a lower surface thereof, to thereby provide the required weight distribution in the head, while also providing a low frictional resistance surface for passing through terrain when a golfer is hitting a golf ball.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENTS OF THE INVENTION

Figures 1, 2, 3:
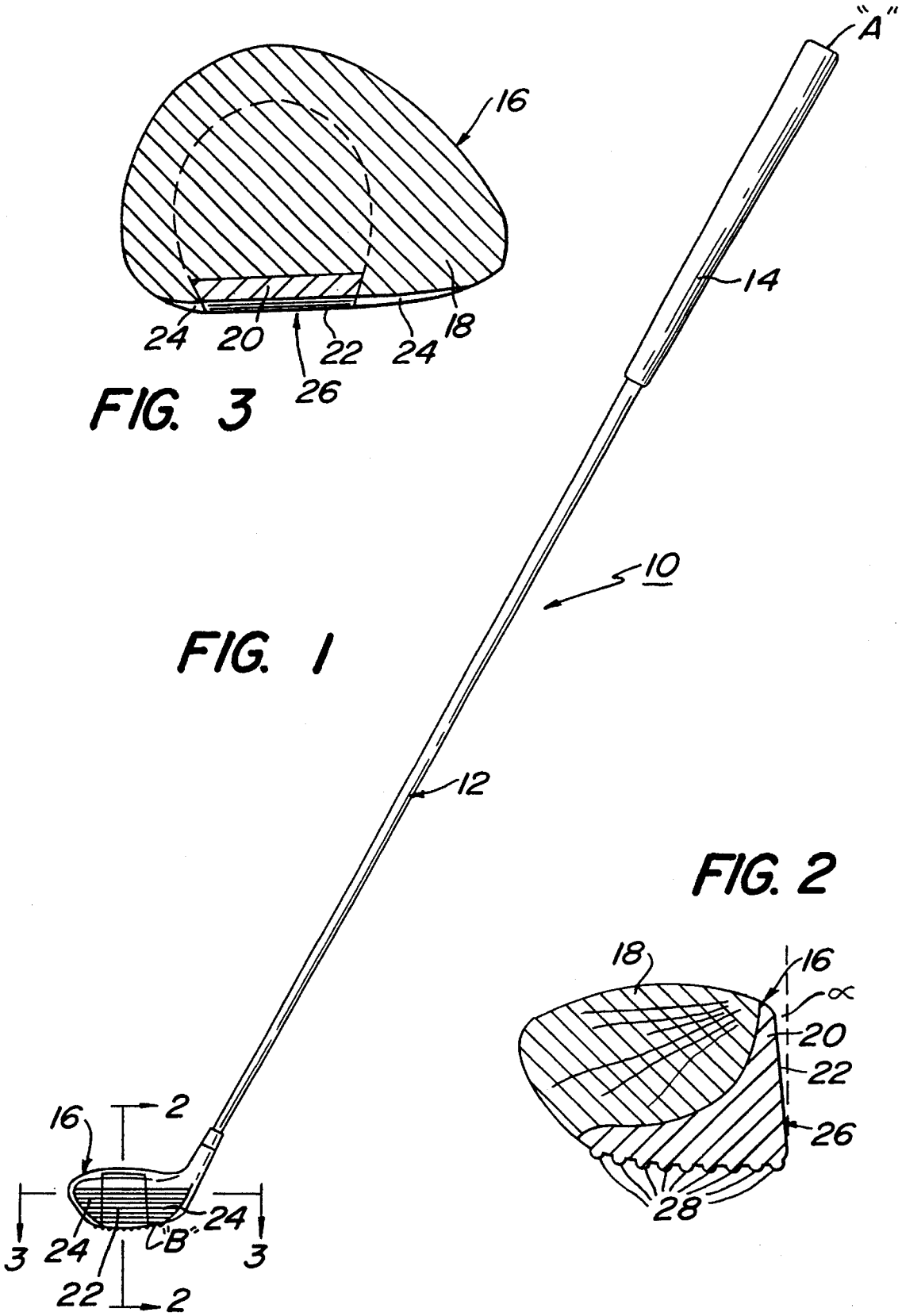
FIG. 1 is a front elevational view of a golf club in the form of a "wood" in accordance with this invention.
FIG. 2 is a sectional view taken along line 2—2 of FIG. 1.
FIG. 3 is a sectional view taken along line 3—3 of FIG. 2.

Referring now in greater detail to the various figures of the drawings wherein like reference characters refer to like parts, a golf club embodying the present invention is generally shown at 10 in FIG. 1. The golf club 10 basically comprises a shaft 12 including a grip 14 at the upper end thereof. The shaft is attached at its lower end to a club head 16.

It should be noted that, in accordance with this invention, the overall height of the golf club 10, measured along the longitudinal axis of the shaft 12 from the upper most point "A" to the lower most point "B", is less than 40 inches. More preferably the overall height is less than 40 inches and greater than 35 inches, and most preferably is approximately 36 inches. Reference to the "height" of the golf club in this application, including the claims, refers to the dimension between points "A" and "B" as described above.

Figure 6:
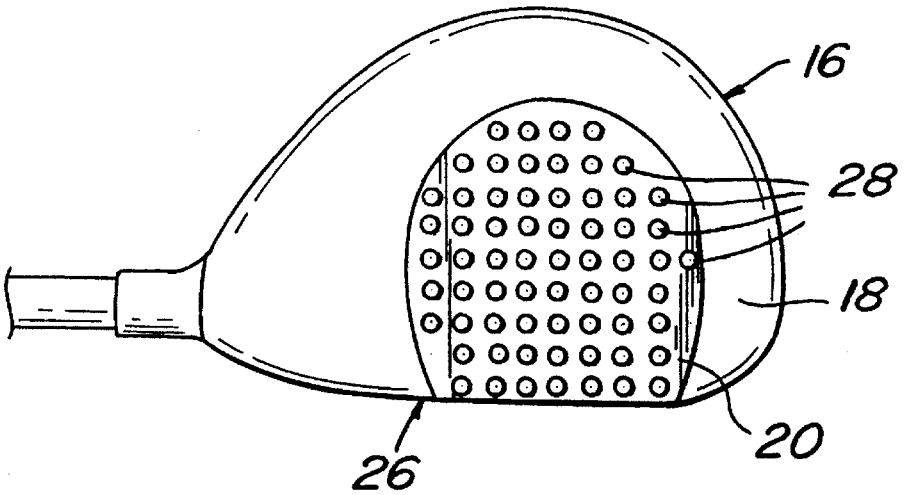
FIG. 6 is a bottom view of the club shown in FIG. 1.

Referring specifically to FIGS. 2, 3 and 6, the club head 16 includes a main wooden body section 18 which is recessed to receive a metal plate 20. The depth of the recess in the body section 18 is such that the forward surface 22 of the metal plate 20 is generally flush with the adjacent forward face 24 of the body section 18. Thus, the forward surfaces 22 and 24 constitute the forward club face 26 of the head 16.

Referring to FIG. 2, the forward club face 26 is generally flat, and is sloped rearwardly in a direction from the lower surface to the upper surface of the club head at an angle, $\alpha$, within the range of 2–7 degrees; more preferably 5–7 degrees, and most preferably 7 degrees.

Referring specifically to FIGS. 2 and 6, the lower surface of the metal plate 20 includes a plurality of spaced-apart, curved projections 28 which are cast as a unitary part of the metal plate. These curved projection minimize the contact area between the lower surface of the club head 16 and the terrain through which the lower surface passes, to thereby minimize frictional resistance when a golf ball is being struck.

In accordance with this invention the metal plate 20 is heavier than the main body section 18, and most preferably is configured to provide more than ½ the club head weight in the lower ½ of the club head height (h), with the club head height being determined at the location where the height of the club head is the greatest. More preferably ¾ or more of the club head weight is in the lower ½ of the club head; and most preferably in the lower ¼ of the club head. Reference throughout this application, including the claims, to club head height, refers to the height of the club head at the location where the height is the greatest.

It should be understood that, in accordance with the broadest aspects of this invention, the required weight distribution can be achieved in a variety of ways. For example, lead weights can be inserted or retained directly in the main wooden body section 18 of the club head 16.

It also should be understood that, in accordance with the broadest aspects of this invention, the weight of the head 16 should be the maximum allowable weight permitted by the United States Golfing Association, since the club 10 of this invention is intended to be used to make long distance, controlled shots, i.e., shots up to approximately 165 yards. In order to provide a controlled shot, the club should be swung carefully and slowly through the golf ball; the heavy weight of the club head 16 being desirable to maximize the distance that the golf ball can be hit with a slow, controlled swing.

Figure 4:
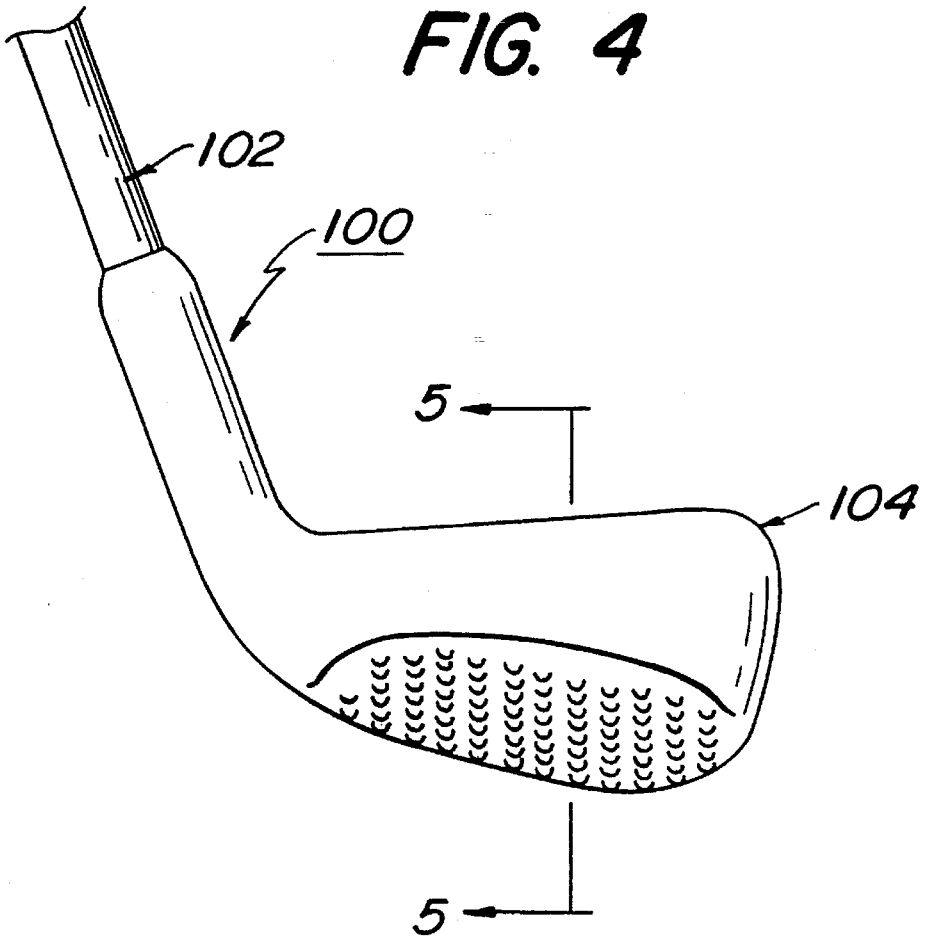
FIG. 4 is a fragmentary, front elevational view of a golf club in the form of an "iron" in accordance with this invention.
Figure 5:
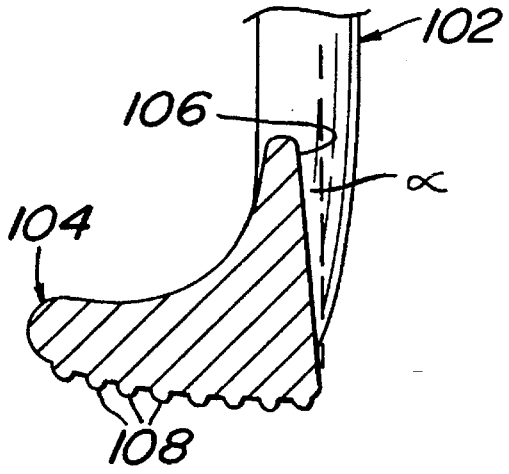
FIG. 5 is a sectional view taken along line 5—5 of FIG. 4.
Figure 7:
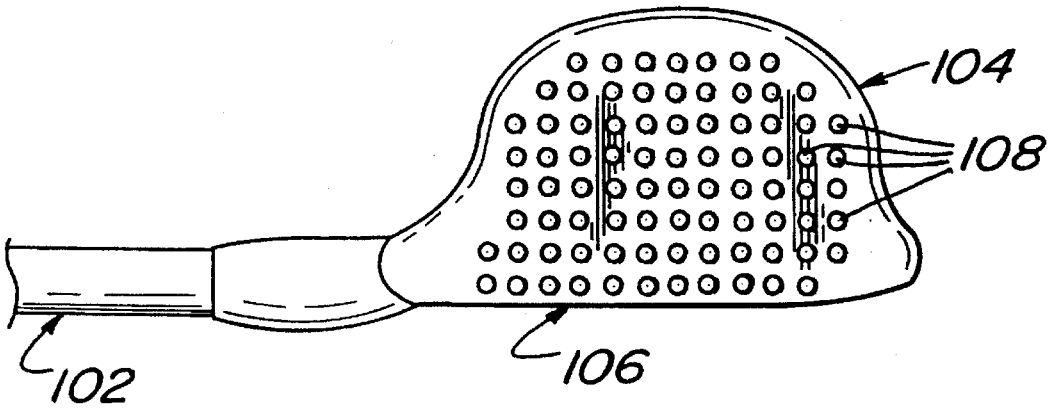
FIG. 7 is a bottom view of the club shown in FIG. 4.

Referring to FIGS. 4, 5 and 7, a golf club, in the form of an iron embodying the present invention is generally shown at 100. This club has the same height limitations as the club 10, and includes a shaft 102 and a head 104. The head 104 preferably is made of iron, or other suitable metal, and has a face 106 sloped rearwardly at an angle $\alpha$ from the lower surface to the upper surface of the face, within the same angle limitations specified for the club face 26 of the club 10.

Still referring to FIGS. 4, 5 and 7, in the preferred embodiment of this invention the club head 104 is cast as a unitary member with spaced-apart curved projections 108 that provide the same function as the curved projections 28 in the golf club 10.

It also should be noted that, in the illustrated embodiment, the shape of the head 104 is designed to provide the same weight distribution as was described previously with respect to the head 16 in the golf club 10. However, if necessary or desired, the weight distribution can be achieved by securing lead weights or other weighted members directly into the head 104.

Applicant has found that by designing the clubs 10 and 100 with the height limitations specified herein, a golfer can grip the club in a conventional manner (e.g., without choking up on the club shaft) and smoothly swing the club through a ball located in difficult terrain, such as high grass, or under low-hanging bushes, shrubs, or other obstacles.

Moreover, by employing club heads having the weight distribution(s) and club face angle(s) specified herein, the golf clubs 10 and 100 of this invention can be swung with a slow, smooth stroke to provide a controlled shot in which the golf ball is quickly lifted off the ground and directed in a low trajectory path for long distances; preferably up to about 165 yards. The low trajectory path is required in order to permit the long distance shot to be accomplished in terrain which includes low hanging tree, branches and similar obstacles.

As stated earlier, the inclusion of spaced-apart curved projections 28 and 108 in the golf clubs 10 and 100, respectively, minimizes the surface area of the lower club surface which engages the terrain when the golf club is being swung through the ball, thereby minimizing frictional resistance. However, it should be understood that in accordance with the broadest aspects of this invention, the projections, although preferred, may be omitted.

Without further elaboration the foregoing will so fully illustrate my invention that others may, by applying current or future knowledge adopt the same for use under various conditions of service.

What I claim as the invention is:

1. A non-putting golf club for use by a player, comprising:

a club shaft having an upper end and a lower end;

a club head attached at said lower end, said club head having a forward club face for engaging a golf ball, and wherein said club face is oriented at an angle between 2 degrees to 7 degrees with respect to a vertical plane, said angle providing for non-putting, low trajectory shots of the golf ball up to approximately 165 yards out of a difficult terrain onto a fairway;

said club head and said club shaft defining a non-putting golf club having a height of less than 40 inches for permitting the player to grip said shaft at said upper end without choking up and to smoothly swing said golf club through the golf ball to provide said low trajectory shots; and said club head being weighted to provide more than ½ of said club head weight in the lower ½ of the height of said club head, said club head comprising a single unitary member.

2. The golf club of claim 1 wherein said angle is between 5 degrees and 7 degrees with respect to a vertical plane.

3. The golf club of claim 1 wherein said angle is 7 degrees.

4. The golf club of claim 1 wherein said height is greater than 35 inches.

5. The golf club of claim 1 wherein said height is approximately 36 inches.

6. The golf club of claim 1 wherein said club head further comprises a lower surface including a plurality of spaced apart, curved projections for passing through the difficult terrain when the golf ball is being hit.

7. The golf club of claim 1 wherein approximately ¾ or more of the club head weight is in the lower ½ of the height of the club head.

8. The golf club of claim 1 wherein said golf club forms an iron.

9. A non-putting golf club for use by a player, comprising:

a club shaft having an upper end and a lower end;

a club head attached at said lower end, said club head having a forward club face for engaging a golf ball, and wherein said club face is oriented at an angle between 2 degrees to 7 degrees with respect to a vertical plane, said angle providing for non-putting, low trajectory shots of the golf ball, up to approximately 165 yards, out of a difficult terrain onto a fairway;

said club head and said club shaft defining a non-putting golf club having a height of less than 40 inches permitting the player to grip said shaft at said upper end without choking up and to smoothly swing said golf club through the golf ball to provide said low trajectory shots; and said club head being weighted to provide more than ½ of said club head weight in the lower ½ of the height of said club head, said club head comprising a main wood portion and a metal plate.

10. The golf club of claim 9 wherein said main wood portion includes a first forward surface and said metal plate includes a second forward surface, said first forward surface and said second forward surface forming said forward club face.

11. The golf club of claim 9 wherein said angle is between 5 degrees and 7 degrees with respect to a vertical plane.

12. The golf club of claim 9 wherein said angle is 7 degrees.

13. The golf club of claim 9 wherein said height is between 35 inches and 40 inches.

14. The golf club of claim 9 wherein said height is approximately 36 inches.

15. The golf club of claim 9 wherein said club head further comprises a lower surface including a plurality of spaced apart, curved projections for passing through the difficult terrain when the golf ball is being hit.

16. The golf club of claim 9 wherein approximately ¾ or more of the club head weight is in the lower ½ of the height of the club head.

17. A method for allowing a player to drive a golf ball out of a difficult terrain having overhanging obstacles and high grass using a non-putting golf club, said method comprising the steps of:

(a) providing a non-putting golf club having a height of less than 40 inches, said club including a club shaft and a club head having a non-putting golf ball striking face oriented between 2 degrees and 7 degrees from a vertical plane and wherein said club head is weighted to provide more than ½ of said club head weight in the lower ½ of the height of said club head, said club shaft having an upper end including a grip;

(b) the player gripping said golf club at said grip without choking up on said club shaft; and (c) the player swinging said golf club smoothly through the ball in a non-choppy stroke to expel the ball at a low trajectory up to approximately 165 yards out of the difficult terrain.

* * * * *